United States Patent [19]

Kobayashi

[11] Patent Number: 4,878,528

[45] Date of Patent: Nov. 7, 1989

[54] ELECTRIC BLIND

[75] Inventor: Masanori Kobayashi, Nagaoka, Japan

[73] Assignee: Kuron Corporation, Japan

[21] Appl. No.: 165,720

[22] Filed: Mar. 9, 1988

[51] Int. Cl.[4] ..... E06B 9/30

[52] U.S. Cl. ..... 160/168.1; 160/178.1; 160/902; 248/262

[58] Field of Search ..... 160/168.1, 900, 902, 160/178.1, 188; 248/262, 254, 265

[56] References Cited

U.S. PATENT DOCUMENTS

| | | | |
|---|---|---|---|
| 3,030,060 | 4/1962 | Breuer | 248/265 |
| 4,293,021 | 10/1981 | Arena | 160/178.1 |
| 4,335,775 | 6/1982 | Frentzel et al. | 160/168.1 X |
| 4,449,564 | 5/1984 | Hansen et al. | 160/168.1 |

FOREIGN PATENT DOCUMENTS

| | | | |
|---|---|---|---|
| 2344288 | 3/1974 | Fed. Rep. of Germany | 160/168.1 |
| 2855813 | 6/1979 | Fed. Rep. of Germany | 160/178.1 |

*Primary Examiner*—Blair M. Johnson
*Attorney, Agent, or Firm*—Steele, Gould & Fried

[57] ABSTRACT

Herein disclosed is an electric blind of the type, in which a traverse rod drive motor, a tilt rod drive motor and their drive transmitting means are arranged at one end side of a casing frame so that the casing frame can be easily cut at the other end side without removing those motors and the drive transmitting means to leave a new casing from of a desired length. The traverse rod and the tilt rod can be cut together with the casing frame to improve the workability of the electric blind. This blind has its slats offset from the center line of the casing frame so that a shield cover can be extended to below the casing frame to prevent the light from breaking therethrough. In this blind, moreover, the positions of the clamping portions of brackets for supporting the two sides of the casing frame can be adjusted independently of one another so that the blind can be mounted on the wall or the like without any difficulty.

10 Claims, 6 Drawing Sheets

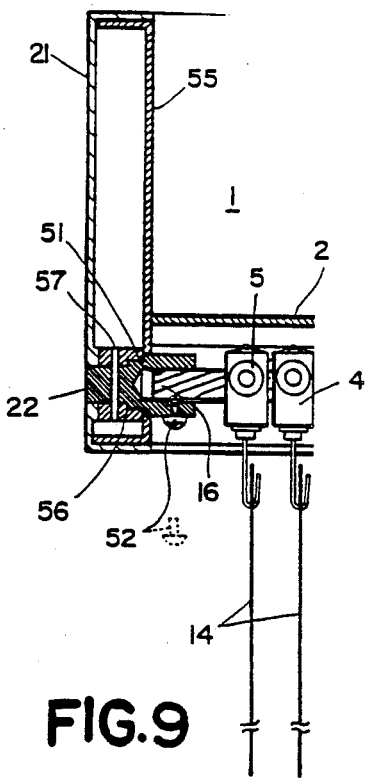
FIG.9
FIG.10
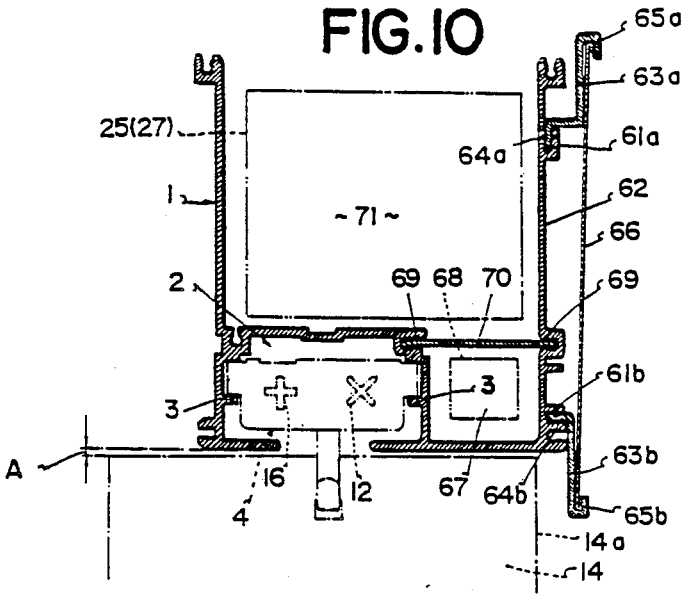
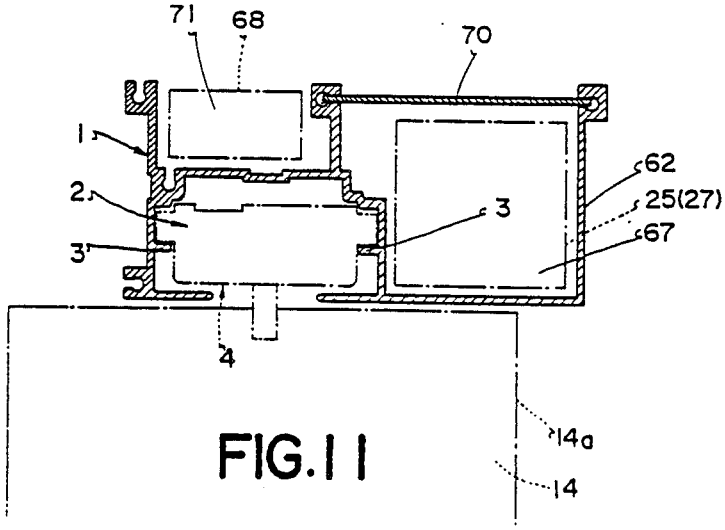
FIG.11
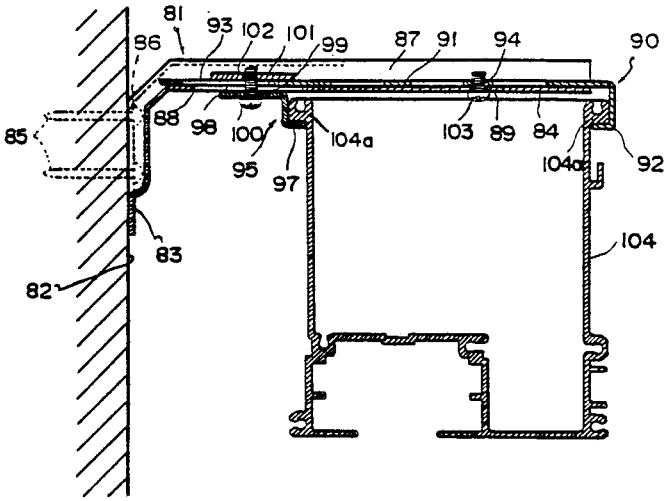
FIG.12

ELECTRIC BLIND

BACKGROUND OF THE INVENTION

1. Field of the Invention

The present invention relates to a vertical blind of electric type and, more particularly, to an electric blind which is electrically powered to have its slats traversed and titled.

2. Description of the Prior Art

Representatives of the vertical blind according to the prior art are disclosed in U.S. Pat. Nos. 4,306,608, 4,262,728 and 4,261,408, for example.

In these vertical blinds, generally speaking, two rods for traversing and tilting slats are rotatably borne in a casing frame in juxtaposition to each other such that the traverse rod is rotated by its drive motor to traverse a plurality of runners reciprocally in the casing frame and such that the tilt rod is rotated by its drive motor to tilt the slats reciprocally, end of which is suspended from the corresponding one of the runners.

Incidentally, in the vertical blind of electric type, the traverse drive motor is arranged in an upper portion of one end of the casing frame whereas the tilt drive motor is arranged in an upper portion of the other end of the casing frame such that the traverse drive motor and the traverse rod are interconnected at one end side of the casing frame by means of a belt and a pulley and such that the tilt drive motor and the tilt rod are also interconnected but at the other end side by means of a belt and a pulley.

Thus, in the prior art described above, the traverse drive motor, its rotation controller, and the drive transmitting means including the belt and the pulley for transmitting the driving power from the motor to the traverse rod are arranged at the one end side of the casing frame, whereas the tilt drive motor, its rotation controller, and the drive transmitting means including the belt and the pulley for transmitting the driving power from the motor to the tilt rod are arranged at the other end side of the casing frame. As a result, the drive motor unit has to be mounted on each of the two ends of the casing frame so that the size of the blind is accordingly enlarged. In addition, in case the casing frame has to be cut in conformity with the various standards of the site, all the drive motor, its rotation controller and the drive transmitting means at either end have to be once disassembled individually and are reassembled after the cutting operation. These works are so troublesome that the blind of the type under discussion is in fact customized at present, thus raising a problem of a low production efficiency.

In this blind, on the other hand, the casing frame is constructed such that the runners are positioned on the center line of the casing frame to run on guide rails.

With this construction of the prior art, the slats suspended from the runners have their two side edges projecting as far as the outside of the casing frame. As a result, a shield cover to be fitted on the outer wall of the casing frame is obstructed by the projected side edges of the slats so that it cannot be extended to below the casing frame, thus raising a problem that the light cannot be prevented without fail from breaking through the clearance between the casing frame and the slats. Since the runners are positioned on the center line of the casing frame, moreover, the electric blind cannot accommodate the whole drive unit in the casing frame so that the drive unit has to be partially arranged outside of the casing frame, and is accompanied by a problem that it is large-sized to have a rather ugly appearance.

In the bracket of the blind, on the other hand, as disclosed in U.S. Pat. No. 4,254,813, the hanger head is fitted in an adjustable manner on the bracket body, but the hanger hook is fixed in position on the hanger head. This in turn fixes the spacing between the one-and other-side clamping portions of the bracket. Moreover, the positioning of the bracket has to be made before the guide rails are attached. In case the mounting support face of a wall or the like is warped or bent, there arises another problem that the brackets cannot be regularly positioned but have to be attached over again.

SUMMARY OF THE INVENTION

It is, therefore, a first object of the present invention to provide an electric blind which can have its drive motor units mounted compactly to facilitate cutting of its casing frame.

A second object of the present invention is to provide an electric blind which allows its casing frame, traverse rod and tilt rod to be cut by a single operation.

A third object of the present invention is to provide an electric blind which has a compact casing frame structure of excellent glare shield.

A fourth object of the present invention is to provide an electric blind which has brackets each capable of adjusting the spacing between its two side clamping portions.

According to a major feature of the present invention, there is provided an electric blind to be mounted on a mounting support face, comprising: a generally elongated casing frame having a pair of longitudinally extending guide rails; at least two brackets fitted on said casing frame for fastening said casing frame therethrough to said mounting support face; a traverse rod borne rotatably in the longitudinal direction of said casing frame; a plurality of runners made rotatable to run one by one on said guide rails when said traverse rod is driven; a plurality of slats each suspended from the corresponding one of said runners; a tilt rod borne rotatably in the longitudinal direction of said casing frame; tilt means each meshing with said tilt rod for tilting said slats when rotated by said tilt rod; traverse drive means for driving said traverse rod when excited; tilt drive means for driving said tilt rod when excited; and drive transmitting means for transmitting the drive forces of said traverse drive means and said tilt drive means to said traverse rod and said tilt rod, respectively, wherein the improvement resides in that said traverse drive means, said tilt drive means and said drive transmitting means are arranged in one end side of said casing frame, whereby said casing frame can be cut at the other end side to leave a new casing frame of a desired length.

BRIEF DESCRIPTION OF THE DRAWINGS

Other objects, features and advantages of the present invention will become apparent from the following description to be made with reference to the accompanying drawings.

FIG. 1 is a top plan view showing the overall structure of an electric blind according to the present invention;

FIG. 2 is an enlarged top plan view showing an essential portion of the electric blind of FIG. 1;

FIG. 3 is a sectional side elevation taken from FIG. 2;

FIG. 4 is an enlarged transverse section taken along line A—A of FIG. 3;

FIG. 5 is similar to FIG. 4 but is taken along line B—B of FIG. 3;

FIG. 6 is similar to FIGS. 4 and 5 but is taken along line C—C of FIG. 1;

FIG. 7 is an enlarged longitundinal section taken along line D—D of FIG. 1; and

FIGS. 8(A) to 8(D) are schematic perspective views for explaining the cutting procedures of the casing frame of the electric blind of FIG. 1.

FIG. 9 is a longitudinal section showing a portion of an electric blind having a bearing unit according to a second embodiment of the present invention.

FIGS. 10 and 11 are transverse sections showing an electric blind having a casing frame structure according to a third embodiment of the present invention.

In FIGS. 12 to 14 showing an electric blind having a bracket assembly according to a fourth embodiment of the present invention:

FIG. 12 is a sectional side elevation showing the overall structure of the bracket assembly;

FIG. 13 is an exploded perspective view showing the bracket assembly of FIG. 12; and FIG. 14 is a top plan view showing the state in which the brackets of FIGS. 12 and 13 are mounted on a mounting support face.

FIG. 15 is a sectional side elevation showing the overall structure of the bracket assembly; and FIG. 16 is a top plan view showing the state in which the brackets of FIG. 15 are mounted on a mounting support face.

DESCRIPTION OF THE PREFERRED EMBODIMENTS

Figure 1:
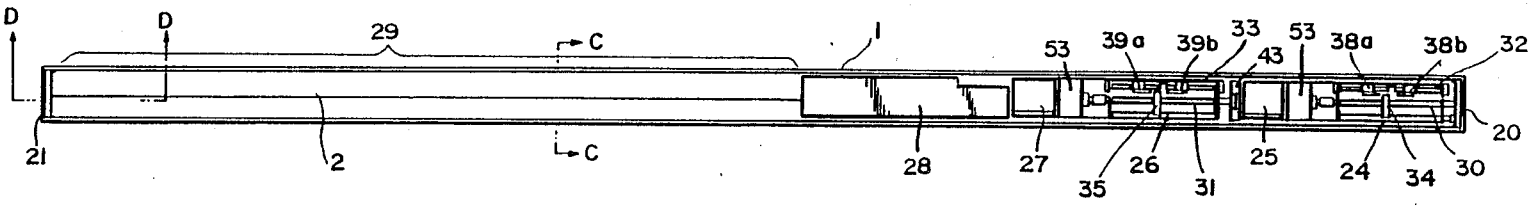
In FIGS. 1 to 8 showing a first embodiment of the present invention.
Figure 2:
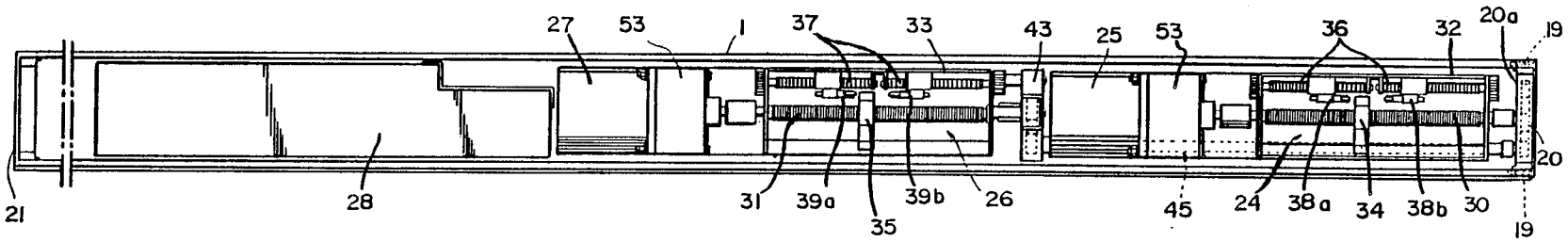
Figure 3:
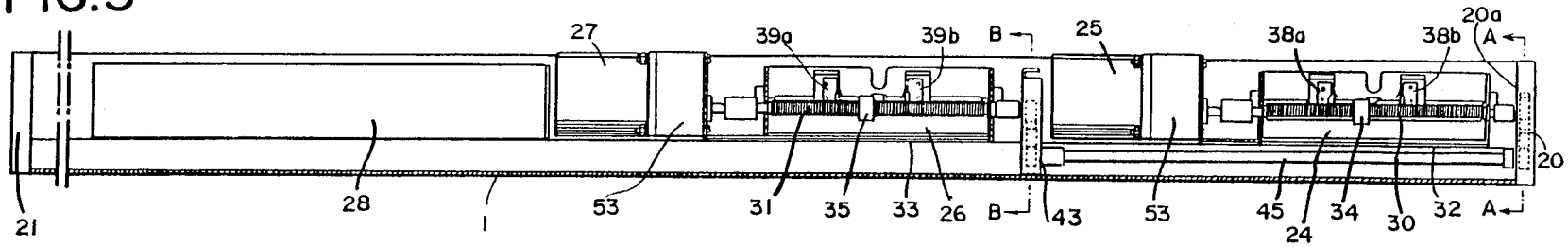

The present invention will be described in the following in connection with the embodiments thereof with reference to the accompanying drawings.

In FIGS. 1 to 7, reference numeral 1 generally denote a casing frame which is made of an aluminum alloy or the like and has a generally square section opened upward. This casing frame 1 is suspended from a support such as the upper frame of a window or a ceiling by means of not-shown mounting brackets. Denoted at numeral 2 is a rod chamber which is defined to extend at one side in the lower portion and along the whole length of the casing frame 1. At the two side walls of the rod chamber 2, there are formed a pair of guide rails 3 which are opposed to each other. In each of the guide rails 3, there are fitted a plurality of pair of rollers 5, the paired ones of which are pivotally borne at the two ends of each runner 4, such that they can run on the guide rails 3. The runner 4 is constructed of a casing 6 which is made of a synthetic resin or the like in a flattened shape. This casing 6 is divided into two compartments 7 and 8, and a worm shaft 9 is rotatably fitted upright in the center of the casing 6 between the two compartments 7 and 8. This worm shaft 9 is in meshing engagement with a worm gear 10 which is rotatably borne in the compartment 7. This worm gear 10 is formed on its axis with a square-shaped fitted bore 11 to which is keyed in a meshing and slidable state a tilt rod 12 having a cross section. Denoted at numeral 13 is a hook which is connected to the lower end of the worm shaft 9 and from which is suspended a slat 14. This slat 14 is offset from the center line of the casing frame 1 such that its edge portion 14*a* is positioned inside of the perpendicular E of the end portion of the casing frame 1.

On the other hand, the other compartment 8 of the casing 6 of the runner 4 does not accommodate anything therein but is formed on its center line with a circular bore 15 in which is slidably and loosely fitted a traverse rod 16 having the construction of a screw shaft. The compartment 8 is further formed in its side wall with an opening 18 in which is fitted a spacer 17. On the other hand, the not-shown leading one of the runners 4 has its compartment 8 formed in its side wall with a circular hole in which is slidably and loosely fitted the traverse rod 16. The other wall of the compartment 8 is formed with a cross-shaped fitting hole to which is keyed the traverse rod 16. Moreover, the leading runner is preceded by a not-shown steady runner.

In the rod chamber 2 formed at one side of the lower portion of the casing frame 1, there are arranged in parallel the aformentioned traverse rod 16 and tilt rod 12 which are pivotally borne by means of bearings 22 and 23 is side plates 20 and 21 which in turn are fastened to the two ends of the casing frame 1 by screws 19.

At one end portion of the casing frame 1 and over the rod chamber 2, there are accommodated sequentially in the recited order a traverse controller 24 of the traverse rod 16, a drive motor 25 of the traverse rod 16, a tilt controller 26 of the tilt rod 12, a drive motor 27 of the tilt rod 12, and a control box 28 for accommodating a not-shown electric circuit or the like therein. With this construction, as shown in FIG. 1, the traverse controller 24, the tilt controller 26, the drive motors 25 and 27, and the control box 28 are accommodated in and arranged at one end of the casing frame 1 to have a length of about one half of the frame 1. The remaining other end half of the casing frame 1 forms a portion 29 to be cut off, if necessary.

Within the traverse and tilt controllers 24 and 26, respectively, there are fitted in limit boxes 32 and 33 threaded rods 30 and 31 which are connected to the respective output shafts of the drive motors 25 and 27. Traverse and tilt control members 34 and 35 are movably screwed on those threaded rods 30 and 31. On threaded rods 36 and 37 which are fitted in parallel with the threaded shafts 30 and 31, respectively, there are movably carried microswitches 38*a* and 38*b*, and 39*a* and 39*b*, the paired ones of which are positioned across the aformentioned traverse and tilt control members 34 and 35, respectively. As the threaded rods 30 and 31 are rotated by the driving forces of the drive motors 25 and 27, the traverse and tilt control members 34 and 35 are moved to rotate on the microswitches 38*a*, 38*b*, 39*a* and 39*b* to send forward, backward and stop commands to the drive motors 25 and 27.

Figure 4:
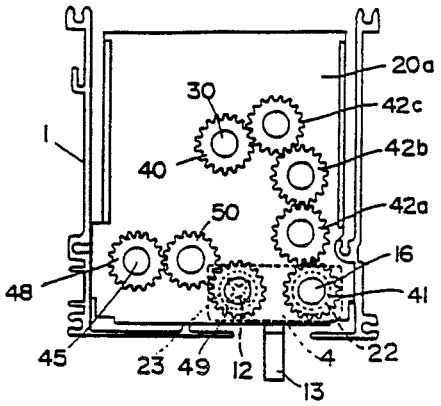
Figure 5:
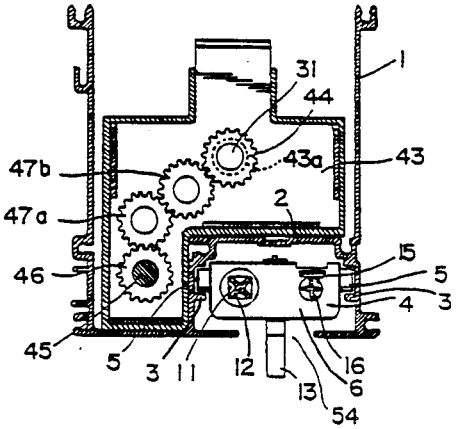
Figure 6:
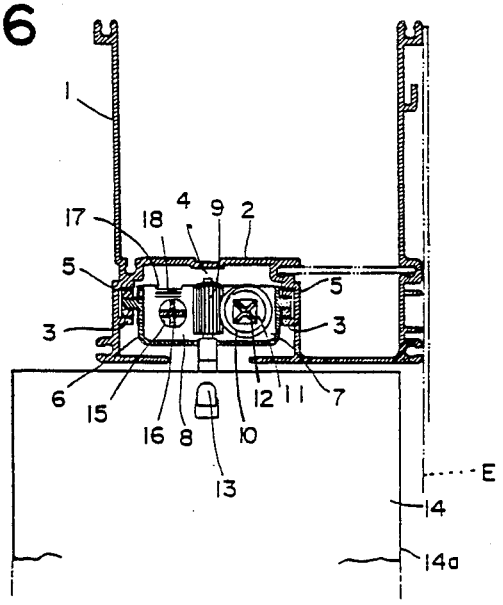

On the other hand, the threaded rod 30 connected to the output shaft of the drive motor 25 of the traverse rod 16 has its one end borne pivotally through the bearing 22 in the inner plate 20*a* of the side plate 20 which is fastened to one end of the casing frame 1 by the screws 19. A gear 40 is fixed on the inserted end of the threaded rod 30. This gear 40 is connected through three intermediate gears 42*a*, 42*b* and 42*c* to a gear 41 which in turn is fixed on the end portion of the traverse rod 16, as shown in FIG. 4. On the other hand, the threaded rod 31 connected to the output shaft of the drive motor 27 of the tilt rod 12 has its one end borne pivotally by a bearing 43*a* of a bearing plate 43 which is interposed between the drive motor 25 and the tilt controller 26. A gear 44 is fixed on the inserted end of the threaded rod 31. Below the drive motor 25 and the traverse controller 24, there is arranged a threaded rod 45 which is positioned in a side portion of the rod chamber 2 to have its two ends borne in the bearing plate 43 and the inner plate 20*a*. On the threaded rod 45 at the side of the bearing plate 43, there is fixed a gear 46 which is connected through two intermediate gears 47*a* and 47*b* to the gear 44 fixed on the threaded rod 31. On an end portion of the threaded rod 45 at the side of the inner plate 20*a*, on the other hand, there is fixed a gear 48 which is connected through one intermediate gear 50 to a gear 49 fixed on an end portion of the tilt rod 12.

Figure 7:
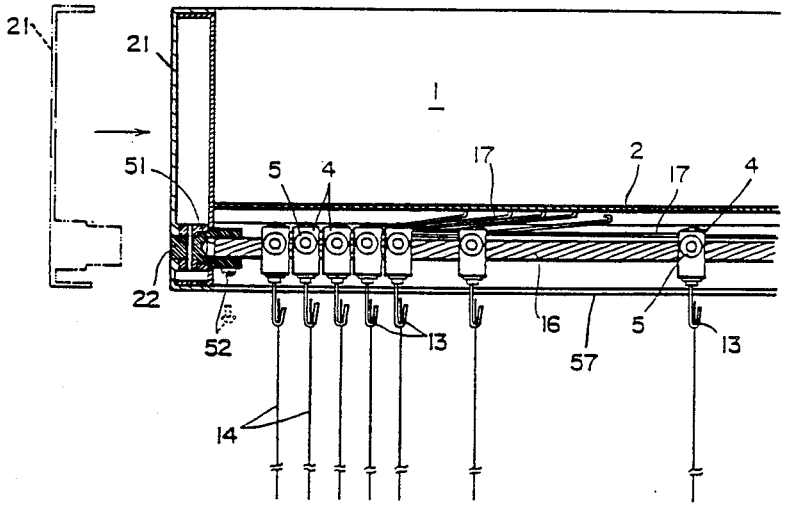

In the bearings 22 and 23 fitted in the other side plate 21 of the casing frame 1, moreover, there are borne those respective end portions of the traverse rod 16 and the tilt rod 12, which are inserted into receiving holes 51 formed in the rotating portions of the bearings 22 and 23 and are fastened by means of screws 52, as shown in FIG. 7. Reference numerals 53 and 54 denote reduction gear mechanisms and an open groove, respectively.

When the drive motor 25 of the traverse rod 16 of the electric blind thus constructed is excited, its rotating force is transmitted sequentially through the threaded rod 30 and the gears 40, 42*c*, 42*b*, 42*a* and 41 to rotate the traverse rod 16. As this traverse rod 16 is rotated, the not-shown leading runner is traversed along the guide rails 3 through the corresponding rollers 5. This leading runner proceeds to a target position while sequentially pulling the succeeding runners 4 through the corresponding spacers 17. At that target position, the rotations of the traverse rod 16 are stopped. If the drive motor 27 of the tilt rod 12 is excited, on the other hand, its rotating force is transmitted sequentially through the threaded rod 31, the gears 44, 47*b*, 47*a* and 46, the threaded rod 45 and the gears 48, 50 and 49 to rotate the tilt rod 12. As this tilt rod 12 is rotated, the worm shaft 9 is rotated through the worm gear 10 so that the slats 14 are tilted and opened to an arbitrary angle. If, at the retraction, the traverse rod 16 is rotated backward, the leading runner retracts to return to its initial position while sequentially pushing the succeeding runners 4. If the tilt rod 12 is then rotated backward, the slats 14 restore their initial angle. Moreover, the forward and backward rotations and the stops of the drive motors 25 and 27 are controlled by the traverse and tilt controllers 24 and 26.

Figure 8A:
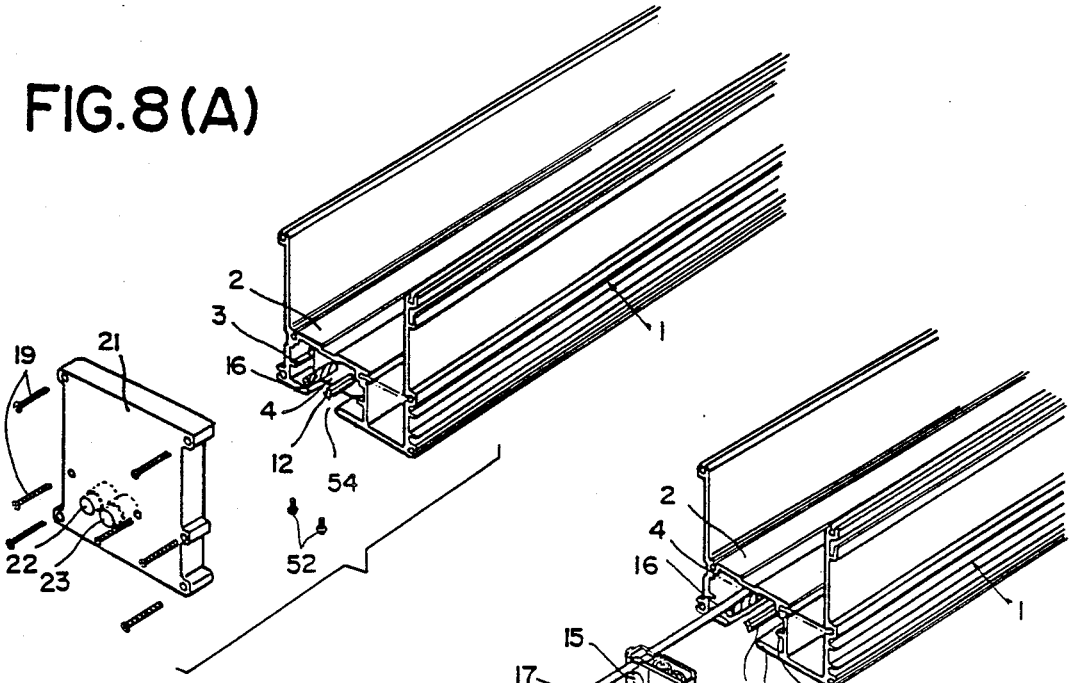
Figure 8:
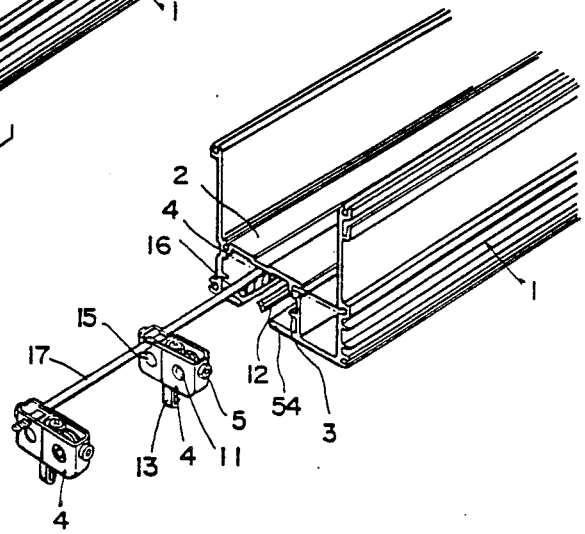
Figure 8C:
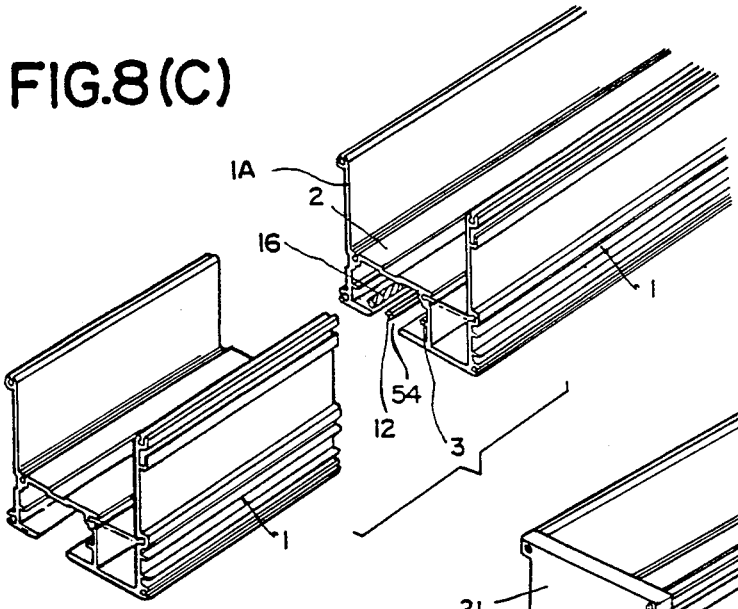
Figure 8:
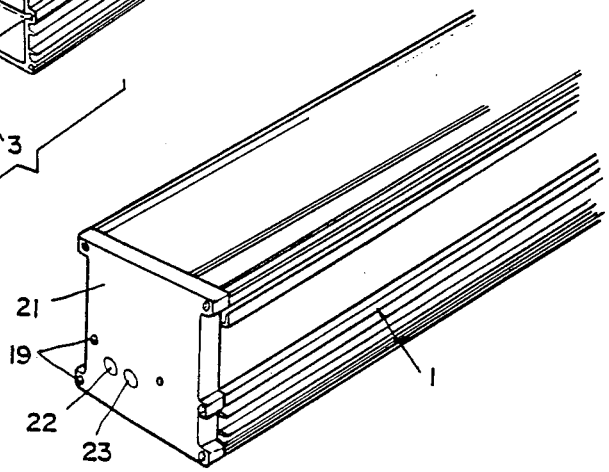

In the embodiment thus far described, the train of gears 40, 41, 42*a*, 42*b* and 42*c* acting as rotation transmitting means for connecting the traverse rod 16 and its drive motor 25 and the train of gears 48, 49 and 50 acting as rotation transmitting means for connecting the tilt rod 12 and its drive motor 27 are arranged through the side plate 20 at one end of the casing frame 1. In the embodiment of FIG. 1, about one half of the other end side of the casing frame 1 can be formed as the portion 29 to be cut off. At the same time, the drive motors 25 and 27, the traverse and tilt controllers 24 and 26, and the control box 28 can be accommodated and arranged compactly within one half length at one end side of the casing frame 1. As a result, when the casing frame 1 is to be partially cut, as shown in FIGS. 8(A) to 8(D), the screws 52 are first loosened from the open groove 54, through which the hooks 13 are allowed to move, and the screws 19 are loosened to remove the side plate 21 from the casing frame 1, as shown in FIG. 8(A). As shown in FIG. 8(B), the spare runners 4 are then extracted to cut off the corresponding spacers 17 and then cut the casing frame 1 to a predetermined length, as shown in FIG. 8(C). After this, as shown in FIG. 8(D), the side plate 20 is attached to the casing frame 1 while inserting the traverse rod 16 and the tilt rod 12 into the corresponding receiving holes 51 of the bearings 22 and 23 and is fixed thereto by the screws 19. Then, the bearings 22 and 23, the traverse rod 16 and the tilt rod 12 are fixed by the screws 52. Thus, none of the drive motors, the traverse and tilt controller and the rotation transmission means such as the gear trains or another combination of belts and pulleys need not be disassembled in the least, as is different from the prior art. As a result, the production efficiency of the electric blind can be remarkably enhanced because the casing frame 1 may be manufactured in conformity with the maximum length of the standards at the site, for example, and can be easily cut and assembled, if necessary.

Incidentally, the present invention should not be limited to the embodiment described above but can be modified in various manners within the gist thereof. Although the drive motors, the traverse and tilt controllers and the limit boxes are accommodated within the range of one half length of the casing frame, as shown in FIG. 1, to allow the remaining other half to be cut off, for example, their accommodating range and the length of the cut portion may be appropriately selected within the one half. Moreover, the embodiment is made by combining the concepts of: arranging at one end of the casing frame the means for transmitting the rotating forces to the traverse rod and the tilt rod; providing the cut portion at the other end; and forming the rod chamber at one side in the lower portion of the casing frame. In short, however, the present invention may be embodied to satisfy at least one of the above-specified three concepts. For example, the rod chamber may be positioned on the center line of the casing frame. Moreover, the present invention can naturally be applied to an electric curtain as well as the electric blind.

FIG. 9 shows a bearing unit which is suitable for cutting the casing frame 1 described with reference to FIG. 8. The portions identical to those of the foregoing embodiment are denoted at the common numerals, and their repeated descriptions will be omitted.

At the other side of the casing frame 1, i.e., the side of the cut portion 29, the side plate 21 is made of a hard synthetic resin such as plastics and is equipped with a metallic inner plate 55 in its inside. In a spacer 56 made of a synthetic resin similar to that of the side plate 21, there are fitted the aforementioned metallic bearings 22 and 23 which are fixed in the spacer 56 by means of pins 57 such that they are rotatable with respect to the side plate 21. The traverse rod 16 and the tilt rod 12 have their end portions inserted into the receiving holes 51 of the bearings 22 and 23, respectively, and are fixed therein by the screws 52. The receiving holes 51 are given a depth to reach at least the spacer side of the inner plate 55 so that the traverse rod 16 and the tilt rod 12 can be inserted into the receiving holes 51 to have their end faces generally coextensive with the open end face of the casing frame 1.

Moreover, let the case be considered in which the side plate 21 is to be fastened to the casing frame 1 by the screws 19, as shown in FIG. 8(D), and in which the traverse rod 16 and the tilt rod 12 are to be inserted into the receiving holes 51 of the bearings 22 and 23 so that they are fastened to the bearings 22 and 23 by the screws 52, as shown in FIG. 9. Then, since the receiving holes 51 are deepened to reach at least the side of the inner plate 55 located at the side of the spacer 56, the traverse rod 16 and the tilt rod 12 can be inserted sufficiently to reach the bottoms of the receiving holes 51 because of the provision of the gap even if they are cut to leave a little longer portion than the cut portion of the casing frame 1.

Thus, the receiving holes 51 for receiving the traverse rod 16 and the tilt rod 12 are so deepened that the casing frame 1 and the traverse and tilt rods 16 and 12 are constructed to have coextensive end faces. In case the blind is to be cut to an arbitrary length, this cutting can be simplified by only one operation because the casing frame 1 and the traverse and tilt rods 16 and 12 have a common length. As a result, the blind is enabled to remarkably enhance its production efficiency merely by manufacturing the blind in accordance with the maximum length of the standards, for example, because it can be cut and reassembled, if necessary, without any difficulty. Incidentally, the bearings 22 and 23 can be made of not only a metal but also a synthetic resin such as plastics, if they can sufficiently endure the fixing force of the screws. Moreover, the side plate 21, the inner plate 55 and the spacer 56 may be made of an appropriate material.

FIGS. 10 and 11 show the detail of the casing frame structure.

In FIGS. 10 and 11, reference numerals 61*a* and 61*b* denote retaining fins which are formed on the front side of the casing frame 1, i.e., at upper and lower portions of an outer wall face 62 opposed to the rod chamber 2. In these retaining fins 61*a* and 61*b*, respectively, there are retained the retained legs 64*a* and 64*b* of cover brackets 63*a* and 63*b*. In the folded edges 65*a* and 65*b* of these cover brackets 63*a* and 63*b*, there is fitted a shield cover 66 which is extended therebetween to below the casing frame 1.

Reference numeral 67 denotes a cord chamber which is formed at the side of the rod chamber 2 for accommodating a cord 68 or the like. A cover 70 is removably fitted on the open top of the cord chamber 67 through fitting grooves 69. Over the rod chamber 2 and the cord chamber 67, moreover, there is formed a drive unit chamber 71 which accommodates therein the drive units such as the motors 25 and 27 and so on for driving the traverse rod 16 and the tilt rod 12.

In the embodiment thus constructed, as shown in FIG. 10, the rod chamber 2 is formed in the lower portion of the casing frame 1 and offset to one side from the center line. In the rod chamber 2, the slats 14 are caused to run along the guide rails 3 on the runners 4 suspended on the line offset from the center line of the casing frame 1. As a result, the edge portions 14*a* of the slats 14 are positioned inside of the outer wall face 62 of the casing frame 1 so that the shield cover 66 can be fitted to extend downward from the casing frame 1 thereby to prevent the light without fail from breaking through a clearance A between the casing frame 1 and the slats 14. Since, moreover, there is formed at the side of the rod chamber 2 the cord chamber 67 which has its top closed with the cover 70, the cord 68 can be neatly arranged to wire the blind without any electric trouble. Still moreover, the drive units can be accommodated in the chamber 71 which is formed over the rod chamber 2 and the cord chamber 67 so that the blind can be made compact to give a neat appearance. Incidentally, the blind can be made more compact by accommodating the not-shown threaded rods or the like of the drive units in the cord chamber 67.

Then, the sizes, shapes and so on of the casing frame and the individual chambers may be appropriately selected, as shown in FIG. 11. Moreover, only one example has been presented as the internal structure of the runner accommodating chamber, which can be modified in various manners. These structures can naturally be applied not only to the blind but also to a curtain. As shown in FIG. 11, on the other hand, the chamber 67 may be equipped therein with the drive units such as the motors 25 and 27 whereas the chamber 71 may be equipped therein with the cord 68 and so on.

Figure 13:
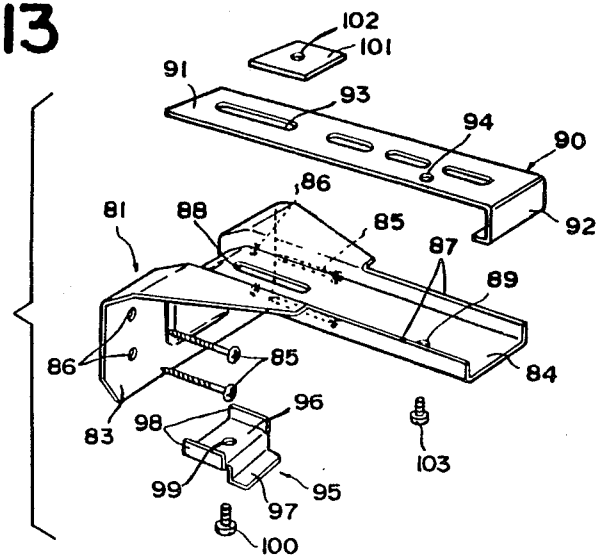
Figure 14:
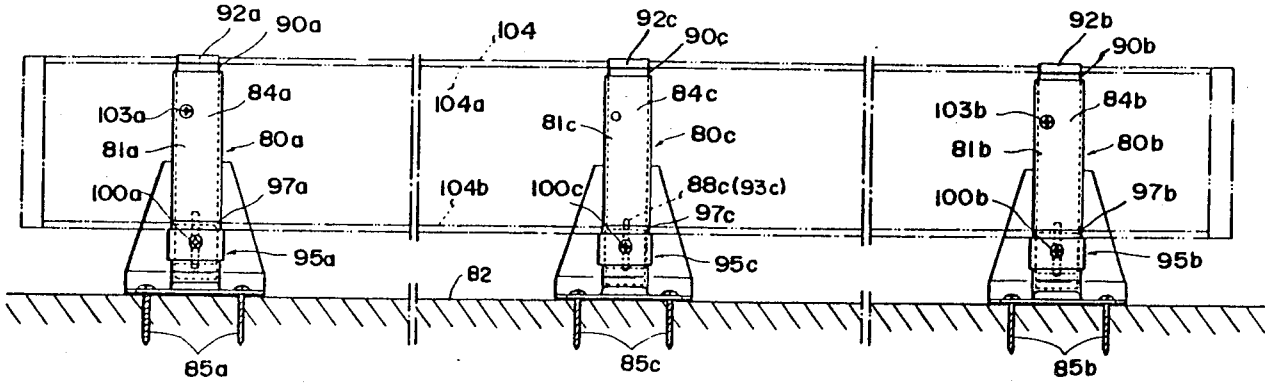

FIGS. 12 to 14 show a bracket for fastening the casing frame to a support such as a wall. In FIGS. 12 and 13, reference numeral 81 denotes a bracket body has a flattened support arm 84 extending at a right angle with respect to a mounted plate 83 which is to be mounted on the mounting face 82 of the wall or the like. The bracket body 81 is formed with screw holes 86 through which is mounted the mounted plate 83 on the mounting face 82 by means of screws 85. On the other hand, the aforementioned support arm 84 has its right and left side edges bent upward to form a pair of guide members 87. The support arm 84 is formed with a first slot 88 at its base end and with a fixing hole 89 at its extending end.

A hanger head 90 to be slid on the upper face of the support arm 84 is constructed of a planar body 91 and a one-side clamping hook 92 extending from one side of the planar body 91. The hanger head 90 is formed with a second slot 93 at the base end of its planar body 91 and with an internally threaded hole 94 at its leading end.

Reference numeral 95 denotes a hanger hook to be slid on the lower face of the support arm 84. This hanger hook 95 is constructed of a planar body 96 to be slidably underlaid on the lower face of the support arm 84, and a stepped clamping end 97 extending from the leading end of the planar body 96. This planar body 96 has its two side edges bent upward to form guide members 98 and is formed with a fixing hole 99 at its center.

Reference numeral 100 denotes a first fixing member or bolt which is screwed through the fixing hole 99 of the hanger hook 95, the first slot 88 of the support arm 84 and the second slot 93 of the hanger head 90 into an internally threaded hole 102 of a nut 101 to be placed on the hanger head 90. Numeral 103 denotes a second fixing member or bolt which is screwed through the fixing hole 89 of the support arm 84 into the internally threaded hole 94 of the hanger head 90. Numeral 104 denotes a casing frame which is formed with one- and other-side ears 104*a* and 104*b* at the two side of its upper portion.

With the construction thus made, the example of supporting the casing frame 104 by the use of three brackets will be described in the following with reference to FIG. 14.

First of all, the first and second brackets 80*a* and 80*b* are fastened to the mounting face 82 at the two sides by means of the screws 85*a* and 85*b*. These first and second brackets 80*a* and 80*b* are prepared such that their one-side clamping hooks 92*a* and 92*b* are slightly protruded and such that the support arms 84*a* and 84*b* and the hanger heads 90*a* and 90*b* are fastened together by means of the second bolts 103*a* and 103*b*. The hanger hooks 95*a* and 95*b* are made slidable with the first bolts 100*a* and 100*b* being loosened.

The third bracket 80c is then fastened to the mounting face 82 generally at the center between the first and second brackets 80a and 80b by means of the screws 85c. More specifically, this third bracket 80c is fastened to the mounting face 82 by the screws 85c without the first bolt 100c, namely, with the hanger hook 95c being unfixed on the bracket body 81c by the first bolt 100c. In this state, the hanger head 90c and the hanger hook 95c of the third bracket 80c are made slidable with their strokes being limited by the coextensive portions of the second and first slots 93c and 88c so that their one- and other-side clamping portions may have their widths maximized.

Next, the one-side ear 104a of the casing frame 104 is fitted on the fixed one-side clamping hooks 92a and 92b of the first and second brackets 80a and 80b, and the hanger hooks 95a and 95b are then moved to fit the other-end clamping ends 97a and 97b on the other-side ear 104b. Then, the hanger hooks 95a and 95b are fastened to the bracket bodies 81a and 81b by means of the first bolts 100a and 100b.

After the casing frame 104 has been thus fixed by the first and second brackets 80a and 80b, the hanger head 90c of the third bracket 80c is moved until its one-side clamping hook 92c is fitted on the one-side ear 104a. The hanger hook 95c is also moved until the other-side clamping end 97c is fitted on the other-side ear 104b. If the first bolt 100 is then fastened, the hanger head 90c and the hanger hook 95c can be fastened together with the nut 101 to the support arm 84c so that the third bracket 80c can then support the casing frame 104.

Since the hanger head 90 having the one-side clamping hook 92 and the hanger hook 95 having the other-side clamping end 97 are slidably attached to the support arm 84 of the bracket body 81, which extends at a right angle from the mounted plate 83, as has been described above, the bracket body 81 can be mounted on the mounting face 82 of the wall or the like by means of the screws 83, and the hanger head 90 and the hanger hook 95 can be adjusted independently of each other.

Thanks to the provision of both the first bolt 100 for fixing the bracket body 81, the hanger head 90 and the hanger hook 95 and the second bolt 103 for fastening the hanger head 90 selectively to the bracket body 81, moreover, the first and second brackets 80a and 80b can have their hanger heads 90a and 90b fixed in advance whereas the third bracket 80c can have its hanger head 90c adjusted freely. As a result, the third bracket 80c is allowed to have its one- and other-side clamping portions 92c and 97c adjusted freely so that they can be fixed on the one- and other-side ears 104a and 104b without any difficulty. Thus, by one set of the bolts, the hanger heads 90a and 90b can be fixed in position in the first and second brackets 80a and 80b, whereas the hanger head 90c can be made slidable in the third bracket 80c.

Still moreover, the first bolt 100 is loosely inserted into the first slot 88 of the support arm 84 and the second slot 93 of the hanger head 90 so that it can adjust and fix the hanger head 90 and the hanger hook 95 to predetermined lengths.

Incidentally, the present invention should not be limited to the aforementioned fourth embodiment but may be modified such that the casing frame is supported by four or more brackets.

Figure 15:
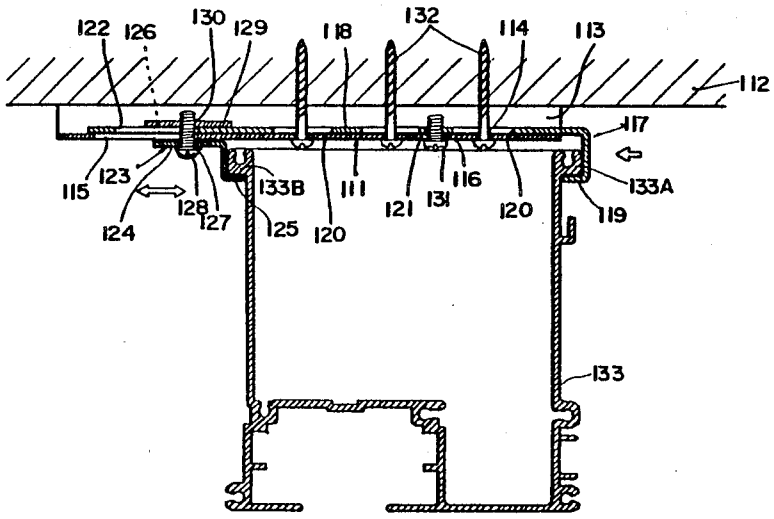
In FIGS. 15 and 16 showing an electric blind having a bracket assembly according to a fifth embodiment of the present invention.
Figure 16:
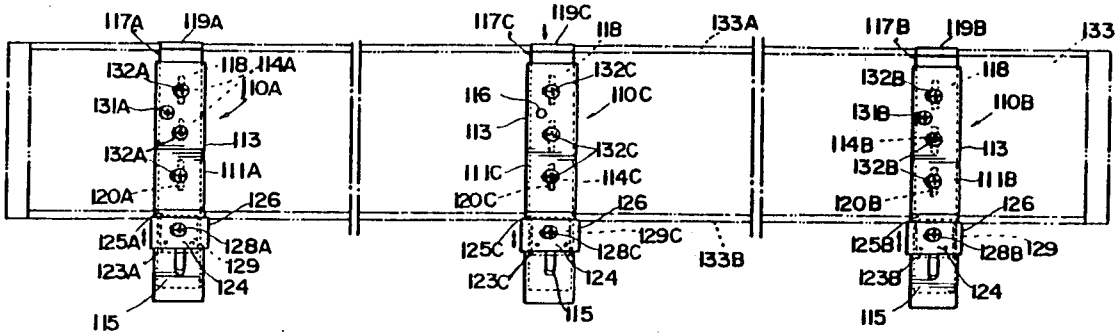

With reference to FIGS. 15 and 16, reference numeral 111 denotes a planar bracket body which is to be mounted on an upper support face 112 such as a ceiling or a window frame. This bracket body 111 has its right and left side edges bent upward to form a pair of guide members 113 opposed to each other and has its one side formed with a plurality of screw holes 114 and its other side formed with a first slot 115. These screw holes 114 and first slot 115 are arranged in the longitudinal direction of the bracket body 111. This bracket body 111 is further formed at its one side with a fixing hole 116 which is offset from the screw holes 114. On the top of the bracket body 111, on the other hand, there is made slidable in the longitudinal direction a hanger head 117. This hanger head 117 is constructed of a planar body 118, which is laid on the top of the bracket body 111 and regulated by the guide members 113, and a one-side clamping hook 119 which extends from one side of the planar body 118. This planar body 118 is formed at its one side with a second slots 120, which are made partially coextensive with the screws holes 114, and with a fixing internally threaded hole 121 which is offset like the fixing hole 116. On the other hand, the other side of the planar body 118 is formed with a third slot 122 which is also made partially coextensive with the aforementioned first slot 115.

Reference numeral 123 denotes a hanger hook which is made slidable on the lower face of the bracket body 111. This hanger hook 123 is constructed of a planar body 124, which is laid on the lower face of the bracket body 111, and a stepped clamping end 125 which is formed at the leading end of the planar body 124. Moreover, this planar body 124 has its right and left side edges bent upward to form a pair of guide members 126 and is formed with a fixing hole 127 at its center.

Reference numeral 128 denotes a first fixing member or bolt, which is screwed through the fixing hole 127 of the hanger hook 123, the first slot 115 of the bracket body 111 and the third slot 122 of the hanger head 117 into a nut 129 which is placed on the planar body 118 of the hanger head 117.

Reference numeral 131 denotes a second fixing member or bolt, which is screwed through the fixing hole 116 into the internally threaded hole 121. Numeral 132 denotes fixing members or screws which are driven through the respective screw holes 114 and the second slots 120 to have their tips anchored in the upper support face 112. Numeral 133 denote a pair of guide rails which are formed with ears 133A and 133B at the two ends of their upper portions.

With this construction thus made, the example of supporting the guide rails 133 by the use of three brackets will be described in the following with reference to FIG. 16.

First of all, the first and second brackets 110A and 110B are fastened to the upper support face 112 at the two sides. More specifically, these brackets 110A and 110B can be mounted by slightly projecting their one-side clamping hooks 119A and 119B, by fixing the bracket bodies 111A and 111B and the hanger heads 117A and 117B by means of the second bolts 131A and 131B, and by driving the fixing screws 132A and 132B through the screw holes 114A and 114B and the second slots 120A and 120B into the upper support face 112. Then, the third bracket 110C to be positioned generally at the center between the first and second brackets 110A and 110B is fastened to the upper support face 112 by the fixing screws 132C without the second bolt, namely, with the hanger head 117C being unfixed on the bracket body 111C. In this state, the hanger head 117C of the third bracket 110C is made slidable with a stroke limited by the length of the second slots 120 so that the spacing between the one- and other-side clamping portions 119C and 125C is set at the maximum.

Next, the one-side ear 133A of the guide rail 133 is fitted on the fixed one-side clamping hooks 119A and 119B of the first and second brackets 110A and 110B, and the hanger hooks 123A and 123B of the first and second brackets 110A and 110B are moved to fit their other-side clamping ends 125A and 125B on the other-side ear 133B. After this, the hanger hooks 123A and 123B are fastened to the bracket bodies 111A and 111B by means of the first bolts 128A and 128B.

After the guide rails 133 have thus been fixed by the first and second brackets 110A and 110B, the one-side clamping hook 119C of the third bracket 110C is fitted on the one-side ear 133A, and the hanger hook 123C is moved to fit its other-side clamping end 125C on the other-side ear 133B. After this, the bracket body 111C, the hanger head 119C, the hanger hook 123C and the nut 129C are fastened together by means of the first bolt 128C so that the guide rails 133 can be supported by the third bracket 110C.

What is claimed is:

1. An electric blind to be mounted on a mounting support face, comprising:

a generally elongated casing frame having a pair of longitudinally extending guide rails;

at least two brackets fitted on said casing frame for fastening said casing frame therethrough to said mounting support face, each of said at least two brackets including a body having a mounted portion to be mounted on said mounting support face, a support arm extending generally at a right angle from said mounted portion, and a first slot formed in a base end of said support arm, a hanger head having a planar body fitted slidably on the support arm of said body of the bracket, a one-side clamping hook formed at a leading end of said planar body, and a second slot formed in the base end of said support arm, a hanger hook having a planar body fitted slidably on the base end of said support arm, and an other-side clamping end extending from the other end of said planar body, first fixing means being inserted through the planar body of said hanger hook and loosely through said first slot and said second slot for fixing said hanger head and said hanger hook on said support arm, and second fixing means for selectively fixing said hanger head on said support arm, said first fixing means having a first bolt and a nut having an internally threaded hole into which said first bolt is screwed, said second fixing means having a second bolt and an internally threaded hole formed in said hanger head;

a traverse rod borne rotatably in the longitudinal direction of said casing frame;

a plurality of runners made rotatable to run one by one on said guide rails when said traverse rod is driven;

a plurality of slats, each suspended from a corresponding one of said runners;

a tilt rod borne rotatably in the longitudinal direction of said casing frame;

tilt means meshing with said tilt rod for tilting said slats when rotated by said tilt rod;

traverse drive means for driving said traverse rod when the traverse drive means is excited;

tilt drive means for driving said tilt rod when the tilt drive means is excited; and, drive transmitting means for transmitting driving forces of said traverse drive means and said tilt drive means to said traverse rod and said tilt rod, respectively, and wherein said traverse drive means, said tilt drive means and said transmitting means are arranged in one end side of said casing frame, whereby said casing frame can be cut at an other end side to leave a casing frame of a desired length.

2. An electric blind according to claim 1, wherein said traverse rod and said tilt rod are disposed in a lower portion of said casing frame, and wherein said traverse drive means, said tilt drive means and said drive transmitting means are disposed in an upper portion of said casing frame.

3. An electric blind according to claim 1, wherein said drive transmitting means includes two trains of gears meshing with said traverse drive means and said traverse rod and with said tilt drive means and said tilt rod, respectively.

4. An electric blind according to claim 1, further comprising:

a plurality of spacers for allowing the leading one of said runners, when said traverse rod is rotated, to proceed while sequentially pulling the succeeding ones of said runners therethrough.

5. An electric blind according to claim 4, wherein the cut portion of said casing frame includes a side plate fitted so removably on the other end side of said casing frame and having a traverse bearing for bearing said traverse rod therein and a tilt bearing for bearing said tilt rod therein that said casing frame can be cut together with a predetermined length of said traverse rod and said tilt rod and a corresponding number of said runners and said spacers when said side plate is removed.

6. An electric blind according to claim 5, wherein said cut portion has at least one third length of said casing frame.

7. An electric blind according to claim 5, wherein the bearings of said side plate have receiving holes extending at least to the open end face of said casing frame so that the open end face of said casing frame and the end faces of said traverse rod and said tilt rod may lie generally on a common plane.

8. An electric blind according to claim 1, wherein said tilt rod is of a screw type having a helical thread, and wherein said tilt drive means includes: a plurality of hooks suspending said slats therefrom, respectively, and a plurality of worm shafts each meshing with the helical thread of said tilt rod and having its lower end connected to the corresponding one of said hooks.

9. An electric blind according to claim 1, further comprising:

a rod chamber formed in said casing frame with an offset to one side from the center line of said casing frame for accomodating said traverse rod and said tilt rod therein and formed therein with said guide rails so that said slats may run along said guide rails with a corresponding offset from the center line of said casing frame.

10. An electric blind according to Claim 9, further comprising:

a shield cover fitted on the outer wall face of said casing frame at the side opposite to that of said rod chamber and extending downward from the lower end of said casing frame.

* * * * *